United States Patent [19]

Kimura et al.

[11] Patent Number: 4,899,085

[45] Date of Patent: Feb. 6, 1990

[54] IGNITING DEVICE FOR A HIGH-PRESSURE DISCHARGE LAMP CAPABLE OF BATTERY VOLTAGE COMPENSATION

[75] Inventors: Mitsutoshi Kimura, Yokohama; Yasuhiro Nieda, Yokosuka, both of Japan

[73] Assignee: Kabushiki Kaisha Toshiba, Kawasaki, Japan

[21] Appl. No.: 161,247

[22] Filed: Feb. 19, 1988

Related U.S. Application Data

[63] Continuation of Ser. No. 924,035, Oct. 28, 1986, abandoned.

[30] Foreign Application Priority Data

Oct. 28, 1985 [JP] Japan ..... 60-240963

[51] Int. Cl.[4] ..... H01K 1/62; H01J 17/34

[52] U.S. Cl. ..... 315/116; 315/115; 315/117; 315/82; 307/10 LS

[58] Field of Search ..... 315/115, 116, 117, 118, 315/82, 86; 307/10 LS

[56] References Cited

U.S. PATENT DOCUMENTS

| | | | |
|---|---|---|---|
| 1,676,793 | 2/1924 | Mailey | 315/116 |
| 1,788,909 | 7/1925 | Buttolph | 315/116 |
| 2,329,584 | 1/1941 | Bourne | 315/116 |
| 4,057,750 | 8/1977 | Elms et al. | 315/86 |
| 4,101,807 | 7/1978 | Hill | 315/116 |
| 4,417,180 | 11/1983 | Chamran et al. | 315/175 |
| 4,459,513 | 7/1984 | Frey et al. | 315/116 |
| 4,645,974 | 2/1987 | Asai | 315/116 |

FOREIGN PATENT DOCUMENTS

| | | | |
|---|---|---|---|
| 51-4881 | 1/1976 | Japan . | |
| 52-110780 | 8/1977 | Japan . | |
| 56-168346 | 12/1981 | Japan . | |
| 58-54547 | 3/1983 | Japan | 315/115 |

*Primary Examiner*—Donald J. Yusko
*Assistant Examiner*—Brian Palladino
*Attorney, Agent, or Firm*—Cushman, Darby and Cushman

[57] ABSTRACT

In an operating apparatus of a high-pressure discharge lamp of the invention, power is supplied to a heater provided in a high-pressure discharge lamp from a battery. The battery is charged by a charger which is driven by a power section. The power section is started by an ON operation of a switch which is turned on/off synchronously with the operation of a control switch. The control switch allows power supply from the battery to the heater when it is turned on. Therefore, always while power is supplied to the heater, the battery is being charged by the charger so that the voltage of the battery will not be lowered.

20 Claims, 10 Drawing Sheets

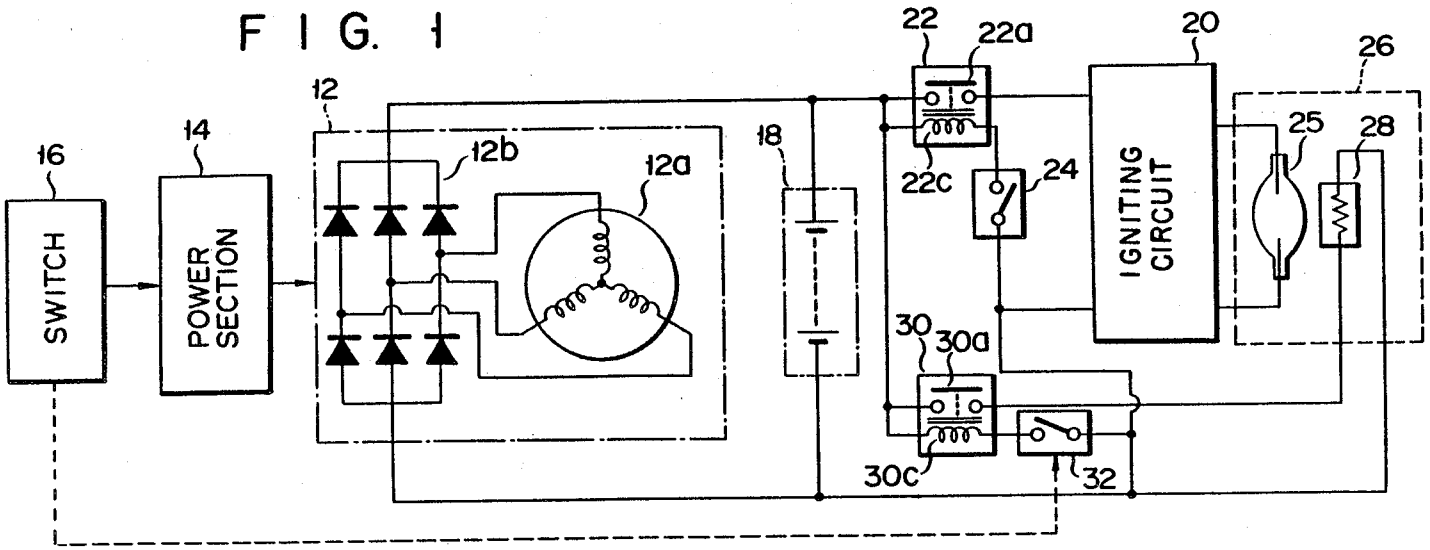
FIG. 1
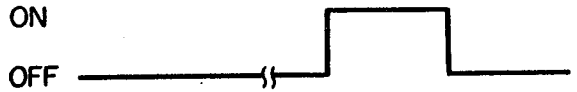
FIG. 2A CHARGER
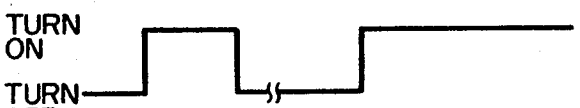
FIG. 2B DISCHARGE LAMP
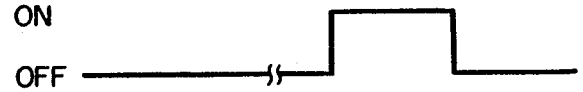
FIG. 2C HEATER

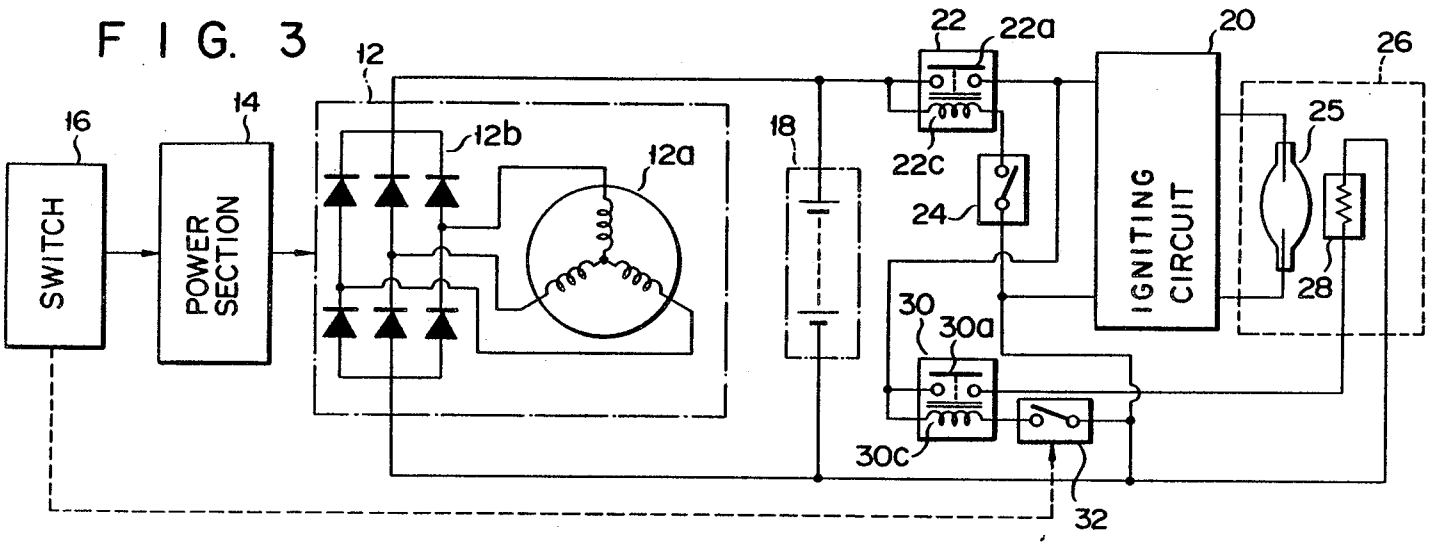
FIG. 3
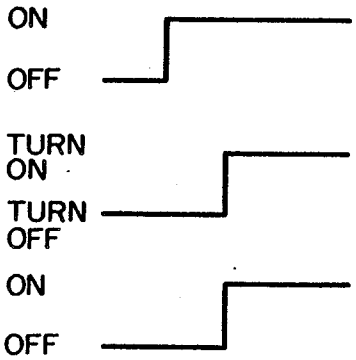
FIG. 4A CHARGER
FIG. 4B DISCHARGE LAMP
FIG. 4C HEATER

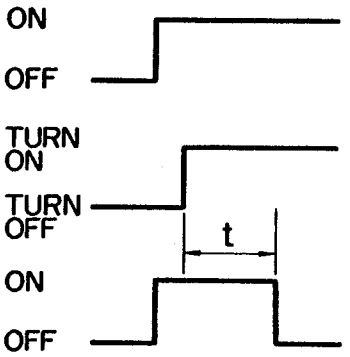
FIG. 6A
FIG. 6B
FIG. 6C
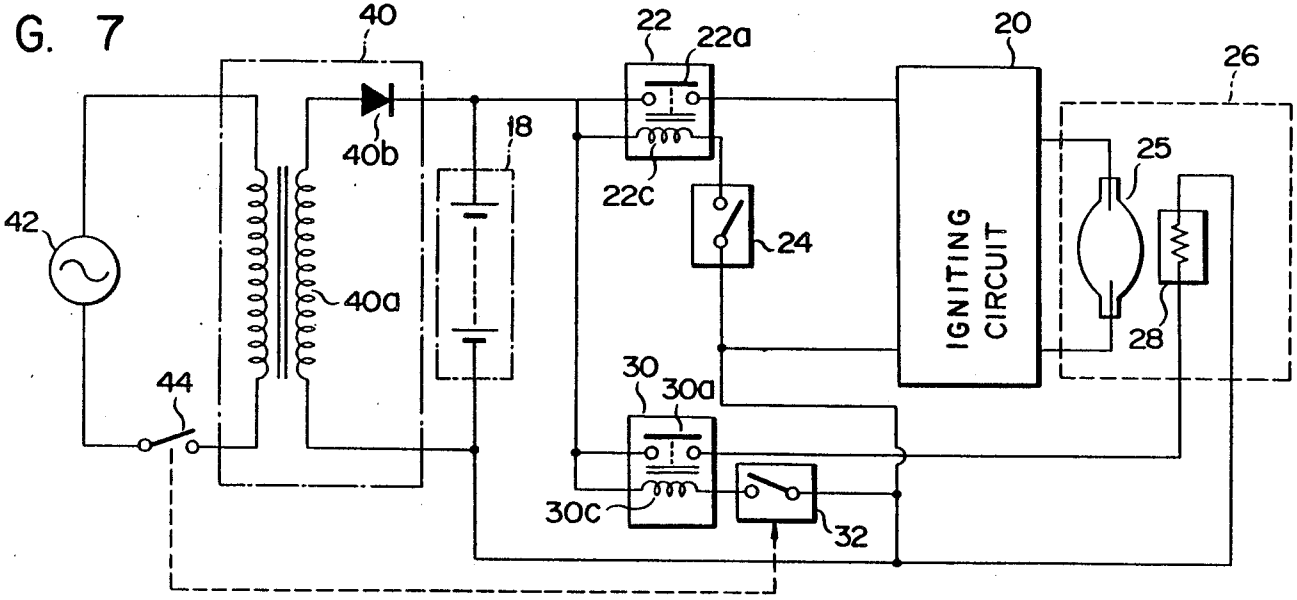
FIG. 7

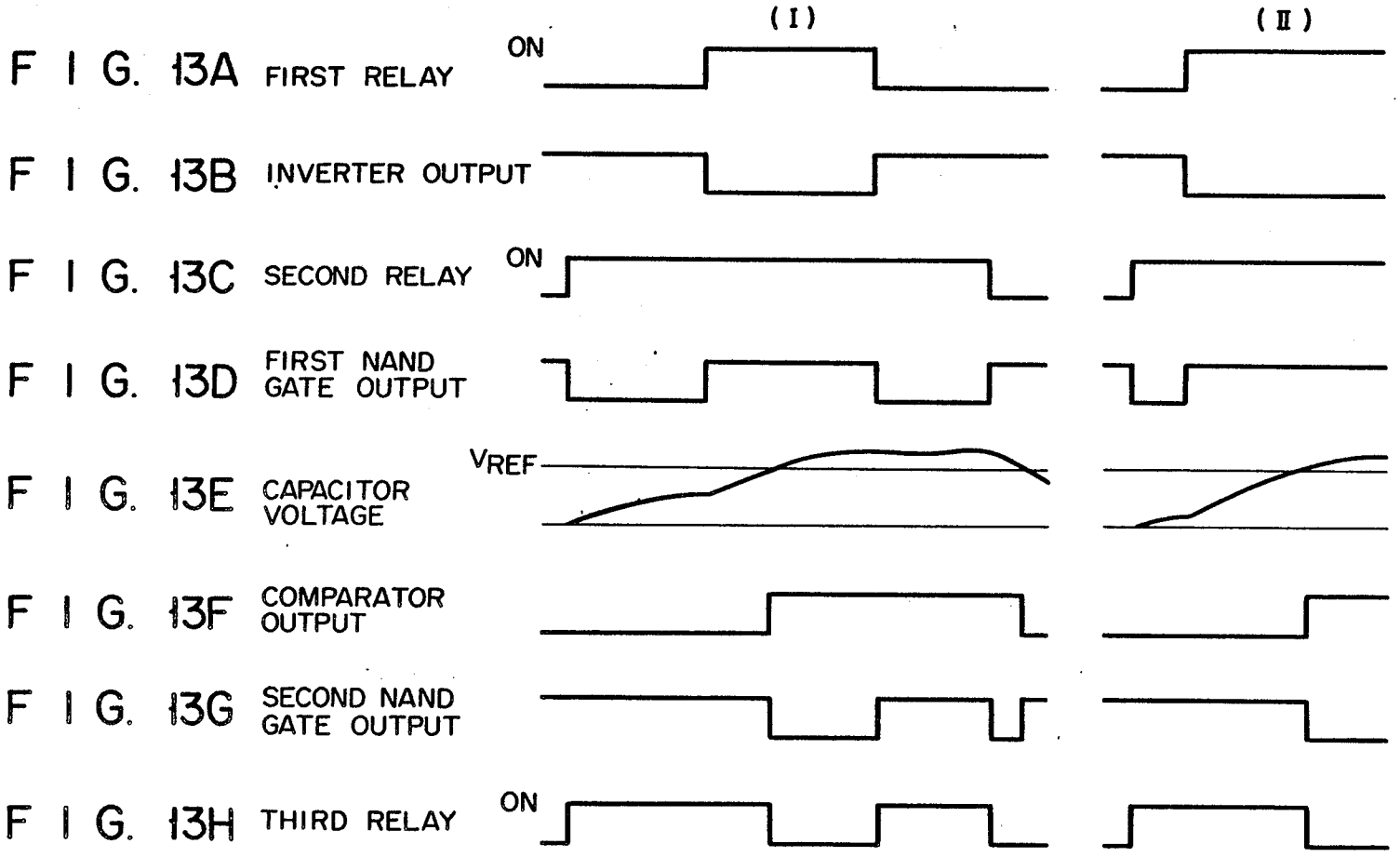
(I)
(II)
ON
FIG. 13A FIRST RELAY
FIG. 13B INVERTER OUTPUT
ON
FIG. 13C SECOND RELAY
FIG. 13D FIRST NAND GATE OUTPUT
VREF
FIG. 13E CAPACITOR VOLTAGE
FIG. 13F COMPARATOR OUTPUT
FIG. 13G SECOND NAND GATE OUTPUT
ON
FIG. 13H THIRD RELAY

IGNITING DEVICE FOR A HIGH-PRESSURE DISCHARGE LAMP CAPABLE OF BATTERY VOLTAGE COMPENSATION

This is a continuation of application Ser. No. 924,035, filed Oct. 28, 1986, which was abandoned upon the filing hereof.

BACKGROUND OF THE INVENTION

The present invention relates to an apparatus for operating a high-pressure discharge lamp and, more particularly, to an apparatus comprising a heater for heating a high-pressure discharge lamp and a battery for supplying power to the lamp and the heater.

A high-pressure discharge lamp has a light-emitting tube filled with a starting rare gas such as mercury or metal halide. A high-voltage pulse is applied to the lamp, whereby the light-emitting tube emits light. The output luminous flux of the lamp increases slowly, however since the mercury or metal halide sealed in the tube has not sufficiently evaporated. It usually takes the luminous flux several minutes to reach a desired value. To solve this problem, a heater can be used to heat the light-emitting tube. When the tube is heated, the mercury or metal halide will quickly evaporate, whereby the luminous flux increases fast upon starting the lamp.

Conventional, high-pressure discharge lamps have been made smaller and smaller, and they are now used as battery-driven portable lamp units such as a video light and an automobile head light. However, when a heater is used in such a battery-driven portable lamp unit to heat the light-emitting tube, the battery voltage is lowered very soon since the heater consumes much power. Once the battery voltage has fallen too much, the discharge lamp can no longer remain on.

SUMMARY OF THE INVENTION

Accordingly, the object of the present invention is to provide an apparatus for starting operating a high-pressure discharge lamp using a battery as a power source, and having a heater for heating the light-emitting tube of the lamp so as to quickly increase the output luminous flux of the lamp without lowering the voltage of the battery in a short time.

According to the invention, there is provided an apparatus for starting and operating a high-pressure discharge lamp, which comprises a high-pressure discharge lamp charging means for generating a charging voltage, a battery connected to the charging means and capable of being recharged by the charging voltage, starting and operating means, having an input end connected to the battery and an output end connected to the high-pressure discharge lamp, for generating a predetermined starting output in order to start and maintain an ON state of the high-pressure discharge lamp, a heater, provided in the high-pressure discharge lamp, for heating the high-pressure discharge lamp, and heater control means, provided between the heater and the battery, for controlling power supply to the heater from the battery, the heater control means enabling power supply to the heater by the battery at least while the charging means operates.

BRIEF DESCRIPTION OF THE DRAWINGS

FIG. 1 is a circuit diagram of an embodiment of the present invention, i.e., an apparatus for starting and operating a high-pressure discharge lamp;

FIGS. 2A to 2C are timing charts showing the operation timings of the components of the apparatus shown in FIG. 1;

FIG. 3 is a circuit diagram of a second embodiment of the invention;

FIGS. 4A to 4C are timing charts showing operation timings of the respective components of FIG. 3;

FIG. 6A to 6C are timing charts showing operation timings of the respective components of FIG. 5;

FIG. 7 is a circuit diagram of a fourth embodiment of the present invention;

FIGS. 13A to 13H are timing charts showing operation timings of the respective components of FIG. 12, each showing sufficient heating (I) and insufficient heating (II).

DETAILED DESCRIPTION OF THE PREFERRED EMBODIMENTS

Figure 8:
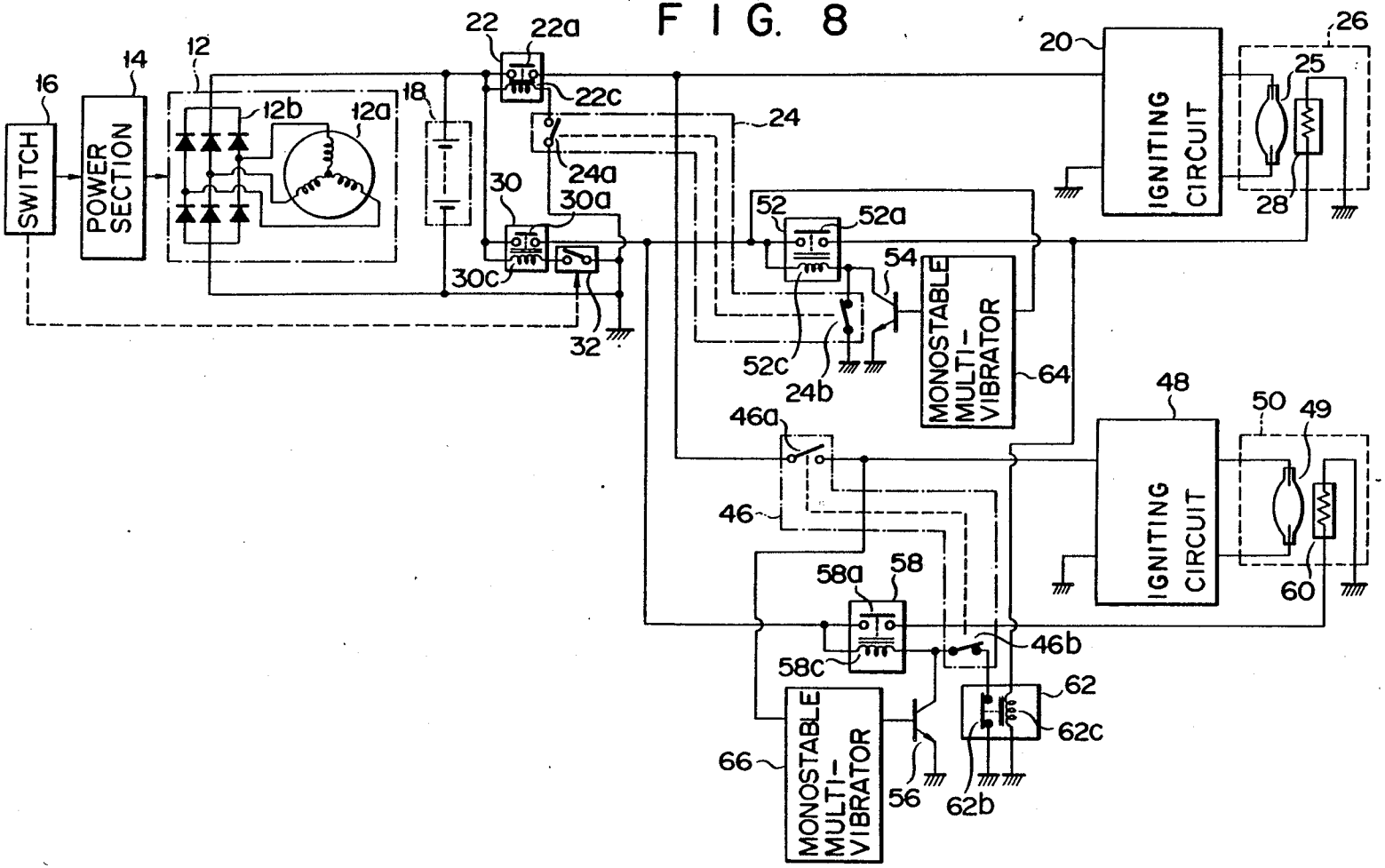
FIG. 8 is a circuit diagram of a fifth embodiment of the present invention.

FIG. 1 shows an arrangement of a starting and operating apparatus of a high-pressure discharge lamp according to a first embodiment of the present invention. Charger 12 consisting of generator 12*a* and rectifier 12*b* is driven by power section 14, such as an automobile engine. Power section 14 is started by operation of switch 16, such as an automobile ignition switch.

Charger 12 is connected to battery 18. Battery 18 is connected to igniting circuit 20 through normally-open contact 22*a* of first relay 22 and coil 22*c* of first relay 22 through operation switch 24.

Igniting circuit 20 is connected to light-emitting tube 25 provided in high-pressure discharge lamp 26. Igniting circuit 20 is a known circuit, and when circuit 20 is connected to battery 18, its internal starter (not shown) is operated to supply a high-voltage pulse to light-emitting tube 25. When light-emitting tube 25 starts to be turned on, the starter is stopped and the ON state of light-emitting tube 25 is maintained.

Heater 28 is provided near light-emitting tube 25 to heat tube 25. Heater 28 is connected in turn to battery 18 through normally-open contact 30*a* of second relay 30. Battery 18 is also connected to coil 30*c* of second relay 30 through control switch 32 which is linked to switch 16. When switch 16 is operated to drive power section 14, the contact of switch 32 is turned on.

More specifically, second relay 30 and switch 32 constitute a control means for stopping power supply from battery 18 to heater 28 when charging from charger 12 to battery 18 is stopped. Therefore, in the first embodiment having the above arrangement, power section 14 is not driven unless switch 16 is operated. Thus, as shown in FIG. 2A, charger 12 does not operate at this time, and battery 18 is not charged.

In this state, when operation switch 24 is turned on, power is supplied to coil 22c of first relay 22. Normally-open contact 22a of relay 22 is thus closed, battery 18 is connected to igniting circuit 20, and light-emitting tube 25 provided in high-pressure discharge lamp 26 is turned on, as shown in FIG. 2B. In this case, however, control switch 32 maintains the OFF state, and power is not supplied to heater 18, as shown in FIG. 2C. Thus, as described above, when battery 18 is not charged by charger 12, power is not supplied to heater 28, and excessive power consumption by battery 18 is prevented.

When switch 16 is operated, power section 14 is driven, and charger 12 is operated to start charging battery 18, as shown in FIG. 2A. Since switch 32 is turned on in synchronism with the operation of switch 16, power is supplied to coil 30c of second relay 30. As a result, normally-open contact 30a of relay 30 is closed, and power is supplied from battery 18 to heater 28, as shown in FIG. 2C. Light-emitting tube 25 provided in high-pressure discharge lamp 26 is heated thereupon, and evaporation of a material sealed in light-emitting tube 25 is promoted.

Thereafter, as shown in FIG. 2B, when switch 24 is operated to turn on discharge lamp 26, light-emitting tube 25 is started with a high rate of increase in luminous flux. However, when switch 16 is turned off, power section 14 and charger 12 are stopped, and power supply from charger 12 to battery 18 is stopped. At this time, control switch 32 is turned off in synchronism therewith, and power supply to coil 30c of second relay 30 is stopped. As a result, normally-open contact 30a of relay 30 is opened, and power supply to heater 28 is stopped. In this manner, since heater 28 is only powered while battery 18 is charged by charger 12, the voltage of battery 18 is not decreased even if power consumption is increased, and the ON state of discharge lamp 26 is not disturbed by a voltage drop of battery 18.

The apparatus of this invention, described above, is advantageous particularly when it is used to start and operate a high-pressure discharge lamp used as an automobile head light. The output luminous flux of a head light must quickly increase as the car starts traveling. The heater of the apparatus is turned on when the automobile engine is started, and remains on until the engine is stopped, and the luminous flux fast increases at the start of the car. Since the heater is on after the start of the engine, and charger 12 charges battery 18 from the moment the engine is started, the voltage of the battery does not fall due to the power consumption of the heater.

Other embodiments of the present invention will be described with reference to the accompanying drawings. The same reference numerals in the drawings denote the same parts as in FIG. 1, and a detailed description thereof is omitted.

FIG. 3 shows a second embodiment of the present invention. The arrangement of FIG. 3 is different from that of FIG. 1 in the following points. Namely, in FIG. 3, heater 28 is connected in series with battery 18 through normally-open contact 22a of first relay 22 and normally-open contact 30a of second relay 30, and coil 30c of relay 30 is connected in series with battery 18 through contact 22a of relay 22 and control switch 32. With this arrangement, even when switch 16 is operated to enable charger 12, as shown in FIG. 4A, and charging from charger 12 to battery 18 is started, heater 28 is not immediately powered since contact 22a of relay 22 is open at this time.

When operation switch 24 is turned on for turning on discharge lamp 26, relay 22 is energized in the above manner to connect igniting circuit 20 to battery 18, and discharge lamp 26 is started, as shown in FIG. 4B. In this case, second relay 30 is also energized in the above manner since control switch 32 is already turned on, and heater 28 is connected to battery 18. In this manner, power supply to heater 28 is started in synchronism with starting of discharge lamp 26, as shown in FIG. 4C. Discharge lamp 26 is heated to a certain degree by heater 28, and the rate of increase in its luminous flux is improved. Thus, in the second embodiment, battery 18 is charged by charger 12, and heater 28 is powered only while discharge lamp 26 is turned on by igniting circuit 20. Therefore, power saving property is better than in the first embodiment described above.

In the second embodiment as well, power supply to heater 28 is started when battery 18 is charged by charger 12, and the same effect as in the first embodiment can be obtained.

Figure 5:
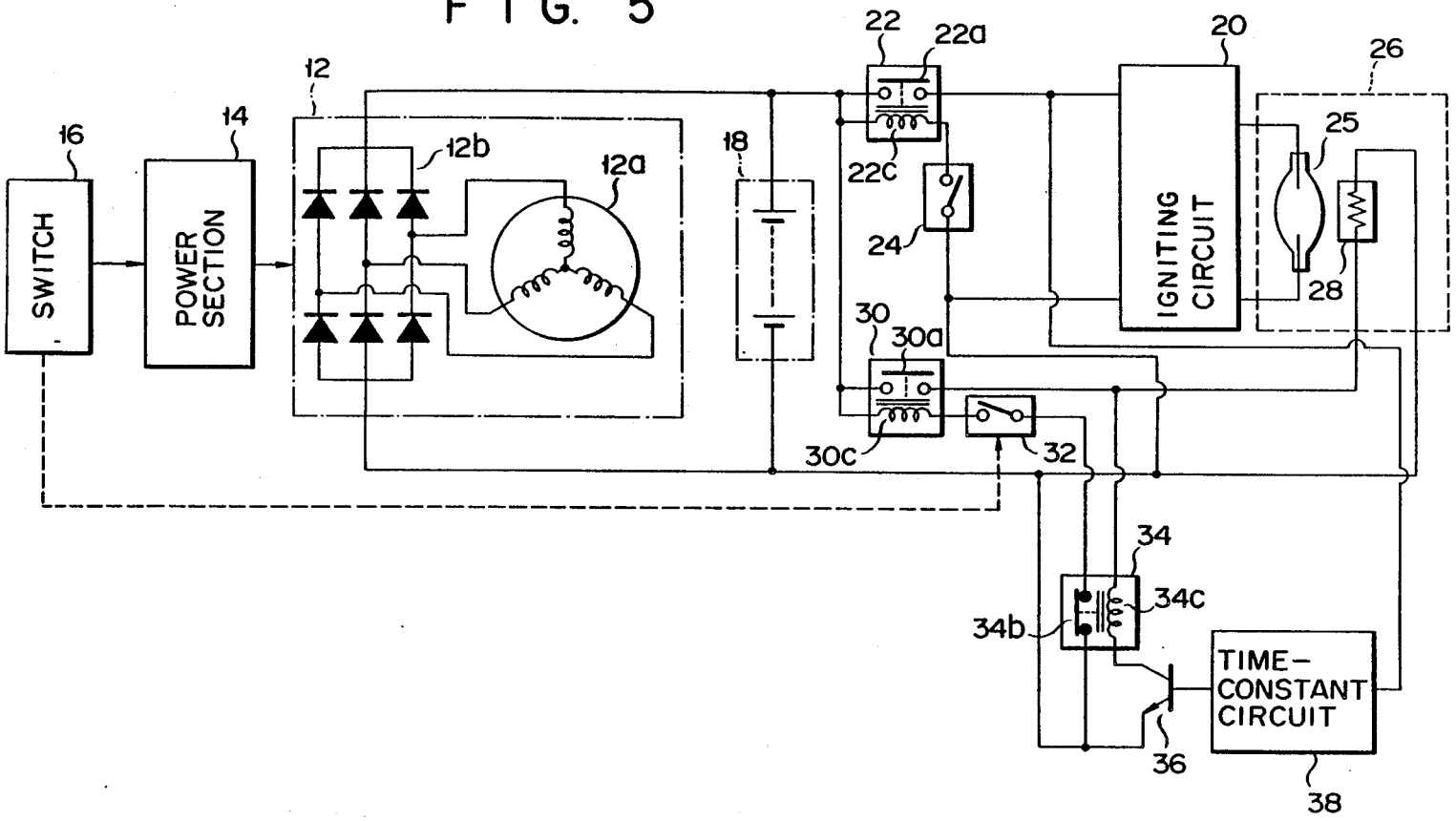
FIG. 5 is a circuit diagram of a third embodiment of the present invention.

FIG. 5 shows an arrangement of a third embodiment, which is different from the first embodiment shown in FIG. 1 in the following points. Namely, in FIG. 5, a series circuit of coil 34c of third relay 34 and npn transistor 36 is connected to battery 18 through normally-open contact 30a of second relay 30, coil 30c of relay 30 is connected in series with battery 18 through control switch 32 and normally-closed contact 34b of relay 34, and time-constant circuit 38, having an output end connected to the base of transistor 36, is provided. Time-constant circuit 38 starts operation in synchronism with igniting circuit 20, and outputs a high-level signal to the base of transistor 36 when a predetermined period of time t has elapsed. Time t set in time-constant circuit 38 is substantially equal to the time required for discharge lamp 26 to reach a stable ON state after it is started.

In the third embodiment having the above arrangement, as shown in FIG. 6A, when switch 16 is operated and charging of battery 18 by charger 12 is started, power supply to heater 28 is started in synchronism therewith, as shown in FIG. 6C. Thereafter, when operation switch 24 is turned on, igniting circuit 20 is operated, and discharge lamp 26 is turned on, as shown in FIG. 6B. When time t has elapsed, i.e., when discharge lamp 26 is started and set in the stable ON state, transistor 36 is turned on by an output from time-constant circuit 38. Then, third relay 34 is energized, and its normally-closed contact 34b is opened. This stops energization of second relay 30, its normally-open contact 30a is opened, and power supply to heater 28 is stopped, as shown in FIG. 6C.

According to the third embodiment, when discharge lamp 26 is set in the stable ON state and heating by heater 28 is not required, power supply to heater 28 can be stopped. Therefore, excessive power consumption can be prevented to achieve power saving, and abnormal heating of discharge lamp 26 by heater 28 can be prevented.

In the third embodiment, power supply to heater 28 is started when battery 18 is charged by charger 12, and the same effect as in the first embodiment can be obtained.

Also in the third embodiment, time-constant circuit 38 is used to measure the transition timing of discharge lamp 26 to the stable ON state in terms of time. However, the present invention is not limited to this. A temperature in the vicinity of discharge lamp 26 or heater 28 can be detected to detect the transition timing of discharge lamp 26 to the stable ON state. Alternatively, since the amount of power supplied to heater 28 is changed depending on temperature, a change in power supply amount can be detected to detect the transition timing of discharge lamp 26 to the stable ON state.

It will be understood with ease that the arrangement consisting of second relay 34, transistor 36, and time-constant circuit 38, as described in the third embodiment, as well can be applied to the second embodiment.

FIG. 7 shows a fourth embodiment of the present invention. The fourth embodiment exemplifies a case wherein the present invention is applied to a unit, such as a video light, which can be used outdoors. More specifically, charger 40 consisting of transformer 40*a* and rectifying diode 40 *b* is used in place of a charger comprising a generator, as in the first embodiment. AC power source 42 is connected to the primary winding of transformer 40*a* through power switch 44, and battery 18 is connected to the secondary winding of transformer 40*a* through diode 40*b*. Control switch 32 is turned on/off in response to the ON/OFF operation of switch 44.

In the fourth embodiment as well, when switch 44 is turned on to start charging battery 18, control switch 32 is turned on, and second relay 30 is energized to start power supply to heater 28. In the fourth embodiment having the above arrangement as well, battery 18 is always charged when heater 28 is powered, and high pressure discharge lamp 26 is heated by heater 28, so that the same effect as in the first embodiment can be obtained.

FIG. 8 shows an arrangement of a fifth embodiment of the present invention, which exemplifies a case wherein a plurality of high pressure discharge lamps, such as high-beam lamps of automobile head light, are to be turned on. More specifically, battery 18 is connected to a series circuit of coil 22*c* of first relay 22 and first switch 24*a* of first operation switch 24. Battery 18 is also connected to first igniting circuit 29 through normally-open contact 22*a* of relay 22. Igniting circuit 20 is connected to light-emitting tube 25 provided in first high-pressure discharge lamp 26.

Battery 18 is also connected in series with second igniting circuit 48 through normally-open contact 22*a* of relay 22 and first switch 46*a* of second operation switch 46. Igniting circuit 48 is connected to light-emittion tube 49 provided in second high-pressure discharge lamp 50.

Battery 18 is also connected to a series circuit of normally-open contact 30*a* of second relay 30, coil 52*c* of third relay 52, and first npn transistor 54. First heater 28 for lamp 26 is connected to battery 18 through contact 30*a* of relay 30 and normally-open contact 52*a* of relay 52. Transistor 54 is connected in parallel with second switch 24*b* of first operation switch 24.

Battery 18 is also connected to a series circuit of second npn transistor 56 and coil 58*c* of fourth relay 58 through normally-open contact 30*a* of relay 30. Battery 18 is also connected to second heater 60 for second discharge lamp 50 through normally-open contact 58*a* of relay 58.

The series circuit of first transistor 54 and coil 52*c* of relay 52 is connected in parallel with coil 62*c* of fifth relay 62 through normally-open contact 52*a* of relay 52. Normally-closed contact 62*b* of relay 62 is connected in parallel with second transistor 56 through second switch 46*b* of second operation switch 46.

First transistor 54 has a base connected to the output end of first monostable multivibrator 64. Multivibrator 64 has an input end connected to battery 18 through normally-open contact 30*a* of relay 30. When a voltage is applied to multivibrator 64, i.e., when relay 30 is energized, multivibrator 64 outputs a high-level signal for a predetermined period of time.

Second transistor 56 has a base connected to the output end of second monostable multivibrator 66. Multivibrator 66 has an input end connected in series with battery 18 through first switch 46*a* of switch 46 and normally-open contact 22*a* of relay 22. When a voltage is applied to multivibrator 66, i.e., when first switch 46*a* of second switch 46 is turned on, multivibrator 66 outputs a high-level signal for a predetermined period of time.

Switches 24*a* and 24*b* of first operation switch 24 operate synchronously and in reverse manners. More specifically, when first switch 24*a* is turned on or off, second switch 24*b* is turned off or on, respectively. Switches 46*a* and 46*b* of second operation switch 46 operate synchronously and in reverse manners as well.

The predetermined periods of time set in multivibrators 64 and 66 are minimum time periods required for high-pressure discharge lamps 26 and 50, respectively, to be sufficiently heated for allowing a luminous flux to be increased fast upon starting the lamps.

In the fifth embodiment having the above arrangement, even if switch 32 is turned on by turning on switch 16, first switch 24*a* remains OFF unless first operating switch 24 is operated, and thus first discharge lamp 26 is not turned on/off by igniting circuit 20. Since first switch 46*a* of second operation switch 46 is turned off, second discharge lamp 50 is not turned on. On the other hand, when control switch 32 is turned on, third relay 52 is energized since second switch 24*b* of first switch 24 is turned on, and power supply to first heater 28 is started. When third relay 52 is energized, coil 62*c* of fifth relay 62 is powered through its normally-open contact 52*a*, and its normally-closed contact 62*b* is closed. At this time, fourth relay 58 is not energized and second heater 60 is not powered. In this manner, when first and second high-pressure discharge lamps 26 and 50 are turned off, only first discharge lamp 26 is heated by first heater 28. At this time, battery 18 is charged in the same manner as described above.

Figures 9A, 9B, 9C, 9D, 9E, 9F:
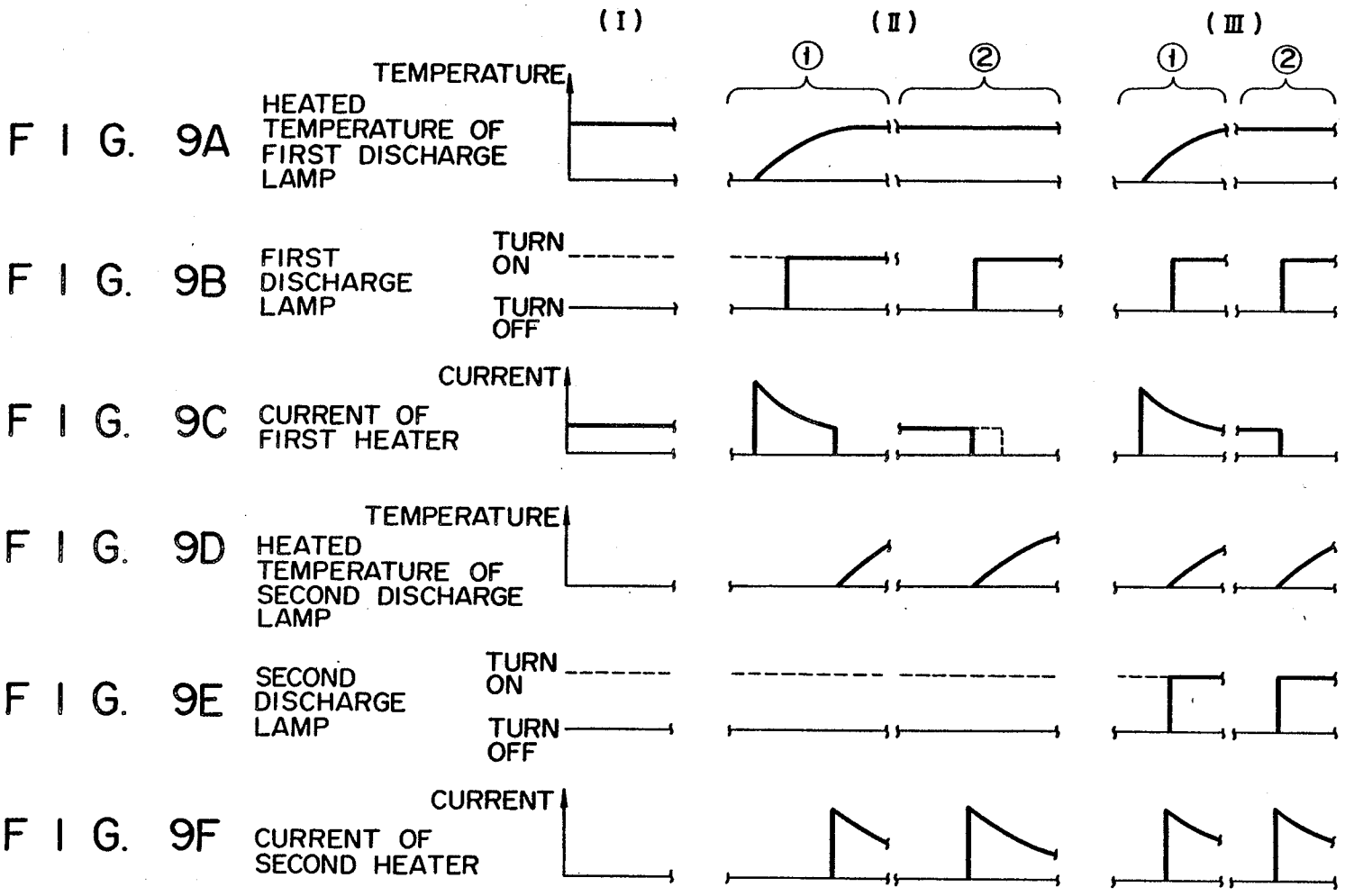
FIGS. 9A to 9F are waveform charts indicating a relationship among a heating temperature state of the respective discharge lamps, the ON/OFF state of the respective discharge lamps, and the current states of the respective heaters of the fifth embodiment, each showing all OFF (I), partially ON (II), and all ON (III) states of the discharge lamps, wherein partially ON (II) and all ON (III) further show insufficient heating (①) and sufficient heating (②) by the heater.

The respective states wherein both discharge lamps 26 and 50 are turned off are as shown in (I) of FIGS. 9A to 9F. In this case, only first heater 28 is powered, as shown in FIG. 9C, and only first high-pressure discharge lamp 26 is heated, as shown in FIG. 9A.

Assume that first discharge lamp 26 is not sufficiently heated by first heater 28 and first switch 24 is operated. In this case, since first and second switches 24*a* and 24*b* are turned on and off, respectively, igniting circuit 20 is operated to start first discharge lamp 26. The states of respective components in this case are as shown in (II) ①of FIGS. 9A to 9F. In this case, when first discharge lamp 26 is started, as shown in FIG. 9B, power supply to first heater 28 is continued, as shown in FIG. 9C, since first transistor 54 is in the ON state for a predetermined period of time after control switch 32 is turned on. Then, first discharge lamp 26 is heated by first heater 28, as shown in FIG. 9A, and its temperature is increased.

Then, the temperature of first high-pressure discharge lamp 26 is increased to a level sufficient for improving the rate of increase in luminous flux, and an output from first multivibrator 64 goes low at that timing. Thus, first transistor 54 is turned off, third relay 52 is deenergized, and power supply to first heater 28 is stopped.

When third relay 52 is deenergized, fifth relay 62 is also deenergized, and power supply to fourth relay 58 through second switch **46*b* of second operation switch 46 and normally-closed contact 62*b* of fifth relay 62 is started, thus energizing relay 58. Then, power supply to second heater 60 is started, as shown in FIG. 9F, and second discharge lamp 50** is heated, as shown in FIG. 9D to increase its temperature.

In this state, when second operation switch 46 is turned on, its first and second switches **46*a* and 46*b* are turned on and off, respectively. Therefore, second discharge lamp 50 is turned on by igniting circuit 48, and power supply to fourth relay 58 through second switch 46*b* is stopped. In this case, second monostable multivibrator 66 is operated synchronously when second switch 46*b* is turned on. Therefore, second transistor 56 is turned on, and fourth relay 58 is kept energized through second transistor 56 in place of through second switch 46*b*, thus maintaining the ON state. Thereafter, after a predetermined period of time has elapsed, an output from second monostable multivibrator 66 goes low, and second transistor 56 is turned off. Thus, fourth relay 58 is deenergized and power supply to second heater 60** is stopped.

When first operation switch 24 is turned on while first discharge lamp 26 is sufficiently heated by first heater 28, its first and second switches **24*a* and 24*b* are turned on and off, respectively, igniting circuit 20 starts operation , and first discharge lamp 26 is started. The respective states in this case are as shown in (II) ② of FIGS. 9A to 9F. Namely, when first discharge lamp 26 is started, second switch 24*b* is turned off since first transistor 54 is already set in the ON state by first multivibrator 64, third relay 52 is thus deenergized, and power supply to first heater 28 is stopped, as shown in FIG. 9C. In this case, some time lag is allowed in the turn-on timing of first heater 28, as indicated by a broken line in the drawing. When third relay 52 is deenergized, fifth relay 62 is also deenergized. Thus, fourth relay 58 is energized to start power supply to second heater 60, as shown in FIG. 9F, and second discharge lamp 50** is heated, as shown in FIG. 9D, to increase its temperature.

As described above, when only first discharge lamp 26 which is preheated by first heater 28 is to be turned on, if it is sufficiently heated at the start of discharge lamp 26, power supply to heater 28 continues after it is started. If discharge lamp 26 is sufficiently heated when it is started, power supply to first heater 28 is stopped.

Assume that first discharge lamp 26 is not sufficiently heated by first heater 28, first and second operation switches 24 and 46 are simultaneously turned on, and both first and second discharge lamps 26 and 50 are started. The states of the respective components in this case are as shown in (III) ① of FIGS. 9A to 9F. Namely, in this case, even when first discharge lamp 26 is started, as shown in FIG. 9B, since first transistor 54 is set in the ON state by first multivibrator 64, power supply to first heater 28 is continued, as shown in FIG. 9C. As shown in FIG. 9A, first discharge lamp 26 is heated by first heater 28 to increase its temperature.

When second operation switch 46 is turned on, its first switch **46*a* is turned on, second multivibrator 66 is operated, and second transistor 56 is turned on. In this case, fifth relay 62 is energized as well since third relay 52 is still being energized, and its normally-closed contact 62*b* is open. Fourth relay 58 is energized by the ON operation of second transistor 56, and power supply to second heater 60 is started, as shown in FIG. 9F. Second discharge lamp 50 is heated by second heater 60**, its temperature is increased, as shown in FIG. 9D, and the rate of increase in its luminous flux becomes high.

Thereafter, first discharge lamp 26 is first heated by first heater 28 to a temperature sufficient for improving the rate of increase of its luminous flux. An output from first multivibrator 54 goes low by this timing to turn off first transistor 54; third relay 52 is deenergized; and power supply to first heater 28 is stopped. Subsequently, second discharge lamp 50 is heated by second heater 60 to a temperature sufficient for improving the rate of increase in its luminous flux. An output from second multivibrator 66 goes low at this timing to turn off second transistor 56; fourth relay 58 is deenergized; and power supply to second heater 60 is stopped.

Assume that first discharge lamp 26 is sufficiently heated by first heater 28, first and second operation switches 24 and 46 are simultaneously turned on, and both first and second discharge lamps 26 and 50 are started. The states of the respective components in this case are as shown in (III) ② of FIGS. 9A to 9F. Namely, in this case, first transistor 54 is already turned off. When first switch **24*a* of first operation switch 24 is turned on to start first discharge lamp 26, as shown in FIG. 9B, second switch 24*b* is turned off to deenergize third relay 52, and power supply to first heater 28** is stopped, as shown in FIG. 9C.

Since second operation switch 46 is turned on, its first and second switches **46*a* and 46*b* are turned on and off, respectively. Thus, second monostable multivibrator 66 is operated to turn on second transistor 56 and to energize fourth relay 58. Power supply to second heater 60 is then started, as shown in FIG. 9F. This increases the temperature of second discharge lamp 50, as shown in FIG. 9D, and the rate of increase in its luminous flux becomes high. Thereafter, when second discharge lamp 50 is sufficiently heated by second heater 60, an output from second monostable multivibrator 66 goes low to turn off second transistor 56. Thus, fourth relay 58 is deenergized, and power supply to second heater 60** is stopped.

In this manner, when both first and second operation switches 24 and 26 are simultaneously turned on while first discharge lamp 26 is not sufficiently heated by first heater 28, thus starting both first and second discharge lamps 26 and 50, power supply to first heater 28 is continued, and power supply to second heater 60 is started. When first discharge lamp 26 is sufficiently heated, power supply to first heater 28 is first stopped. Thereafter, when second discharge lamp 50 is sufficiently heated, power supply to second heater 60 is stopped. As a result, the rate of increase in luminous flux of discharge lamps 26 and 50 upon starting is improved by heating by heaters 28 and 60. In addition, since power supply to heaters 28 and 60 is stopped when discharge lamps 26 and 50 are sufficiently heated, excessive power consumption by the respective heaters can be prevented, thus minimizing power consumption.

Power is supplied to heaters 28 and 60 through second relay 30 which is energized by the ON operation of control switch 32, i.e., by the ON operation of switch 16. Therefore, battery 18 is charged when power is supplied to heaters 28 and 60, and voltage drop does not occur in battery 18.

In the fifth embodiment, first discharge lamp 26 is always turned on prior to second discharge lamp 50. However, the present invention is not limited to this. A switch for switching between the current paths of first and second discharge lamps 26 and 50 can be provided, or a switch for switching between current paths of first and second heaters 28 and 60 can be provided. In this case, either of first and second discharge lamps 26 and 50 can be turned on prior to the other by reversing operation of these switches.

Figure 10:
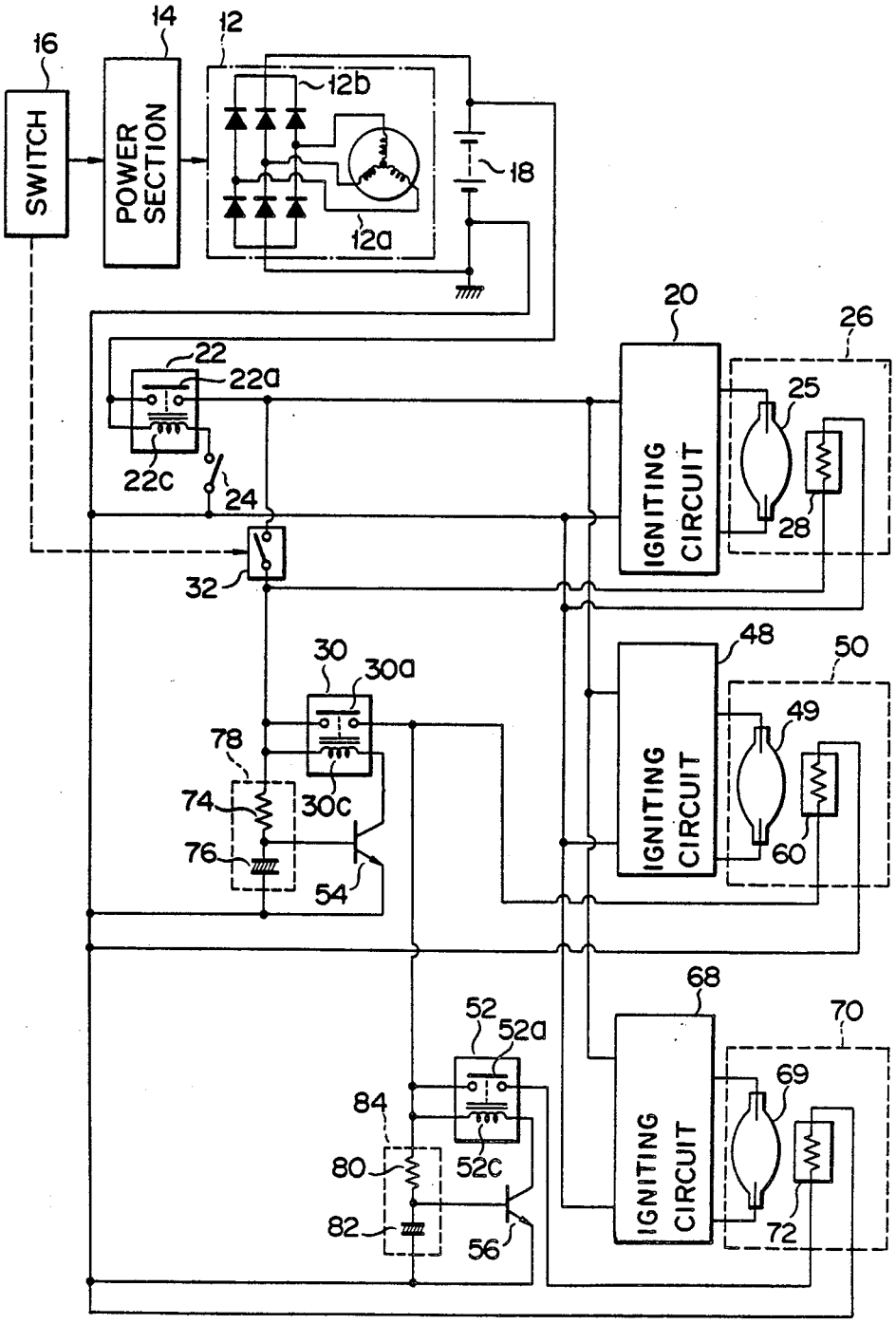
FIG. 10 is a circuit diagram of a sixth embodiment of the present invention.

FIG. 10 shows a sixth embodiment of the present invention wherein a starting and operating apparatus of a high-pressure discharge lamp in accordance with the present invention is applied to a circuit including a means for preventing an excessive inrush current from flowing when a plurality of heaters are energized. More particularly, battery 18 charged in the same manner as in the embodiments described above is connected to coil **22*c* of first relay 22 through operation switch 24, and to first, second, and third igniting circuits 20, 48, and 68 through normally-open contact 22*a* of relay 22. Light-emitting tubes 25, 49 and 69 provided in first, second, and third high-pressure discharge lamps 26, 50, and 70 are connected to the output ends of igniting circuits 20, 48, and 68**, respectively.

High-pressure discharge lamps 26, 50, and 70 have first, second, and third heaters 28, 60, and 72, respectively. First heater 28 provided in first discharge lamp 26 is connected to battery 18 through normally-open contact **22*a* of first relay 22**.

Battery 18 is also connected to first time-constant circuit 78, as a series circuit of resistor 74 and capacitor 76, through normally-open contact **22*a* of first relay 22. First time-constant circuit 78 is connected in parallel with a series circuit of coil 30*c* of second relay 30 and first npn transistor 54. The base of first transistor 54 is connected to the node of resistor 74 and capacitor 76**.

Second heater 60 provided in second high-pressure discharge lamp 50 is connected in series with battery 18 through normally-open contact **22*a* of first relay 22 and normally-open contact 30*a* of second relay 30**.

Battery 18 is also connected to second time-constant circuit 84 as a series circuit of resistor 80 and capacitor 82, through normally-open contact **22*a* of first relay 22 and normally-open contact 30*a* of second relay 30. Second time-constant circuit 84 is connected in parallel with a series circuit of coil 52*c* of third relay 52 and second npn transistor 56. The base of second transistor 56 is connected to the node of resistor 80 and capacitor 82**.

Heater 72 provided in third discharge lamp 70 is connected in series with battery 18 through normally-open contact **22*a* of first relay 22, normally-open contact 30*a* of second relay 30, and normally-open contact 52*a* of third relay 52**.

Time-constant circuits 78 and 84 have, e.g., the same time constants.

In the sixth embodiment having the above arrangement, when operation switch 24 is turned on, first relay 22 is energized, and respective igniting circuits 20, 48, and 68 are started. When switch 16 is turned on, control switch 32 is turned on, power supply to first heater 28 is started, and first time-constant circuit 78 is operated. Then, discharge lamps 26, 50, and 70 are started, and simultaneously first discharge lamp 26 is first heated by first heater 28, thus promoting evaporation of the metal sealed in light-emitting tube 25. A large inrush current flows in first heater 28 upon start of power supply since its temperature is low in this case. However, since power is supplied only to first heater 28, an excessive inrush current does not flow.

When time t elapses, first transistor 54 is turned on by the charged voltage of capacitor 76 and second relay 30 is energized. This time, power supply to second heater 60 is started. In this case, an inrush current flows in second heater 60. However, since first heater 28 is already heated and current flowing therethrough is small, although an overall current is increased, no abnormally excessive current flows therein. Second time-constant circuit 84 starts operation in response to energization of second relay 30. As a result, second discharge lamp 50 is heated by second heater 60, and evaporation of the metal sealed in light-emitting tube 49 is promoted.

When another time t elapses, second transistor 56 is turned on by the charged voltage of capacitor 82, and third relay 52 is energized. Power supply to third heater 72 is started. In this case, an inrush current flows in third heater 72. However, although a total current is increased, since first and second heaters 28 and 60 are already operated and current flowing therethrough is small, no abnormally excessive current flows therein, unlike a case wherein the inrush current flows through all of heaters 28, 60, and 72. This time, third discharge lamp 70 is heated by third heater 72, and evaporation of the metal sealed in light-emitting tube 69 is promoted.

When all heaters 28, 60, and 72 are heated and operated, a total current flowing therethrough is gradually decreased until it is almost stabilized at a predetermined level.

Figure 11A:
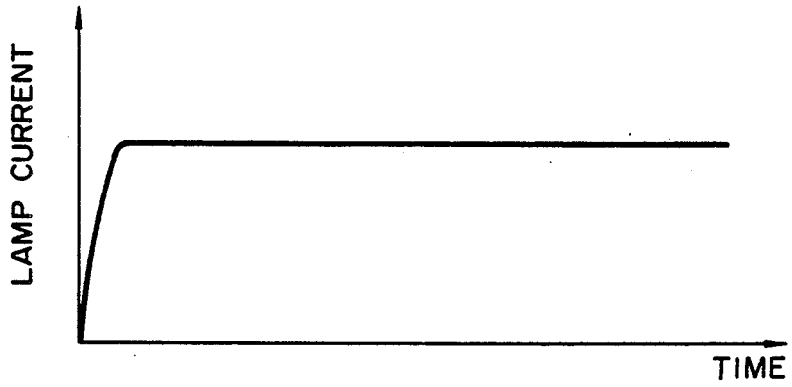
FIGS. 11A and 11B are graphs showing characteristics of the lamp current and the heater current of the sixth embodiment.
Figure 11B:
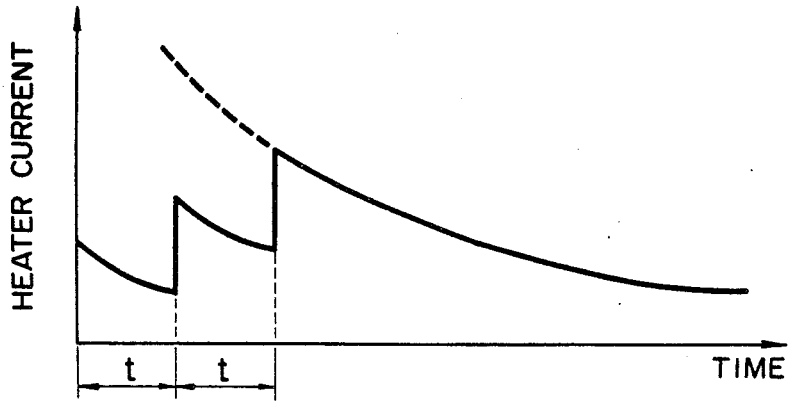

Therefore, at starting, a total lamp current flowing through light-emitting tubes 25, 49 and 69 is increased as soon as they are started, as shown in FIG. 11A. The total heater current flowing through heaters 28, 60, and 72 is increased a little every time t elapses, as shown in FIG. 11B. In this case, however, its peak value is not much increased. Thus, the peak value of the current supplied by battery 18 can be sustained comparatively low compared to a case wherein all heaters 28, 60, and 72 are powered simultaneously (as indicated by broken line in FIG. 11B), and a battery 18 having comparatively small capacity can be satisfactorily used.

Power supply to the heaters is started simultaneously with or after starting of the discharge lamps. The discharge lamps are heated by the heaters upon starting. Therefore, the rate of incrase in luminous flux is improved, and the discharge lamps can be set in a stable ON state with comparative ease. As in the other embodiments, battery 18 is charged when a heater is powered. Therefore, even if power consumption is increased, the voltage of battery 18 is not decreased.

Various circuit configurations, as described above, to prevent an excessive inrush current from flowing can be proposed. The present invention is similarly applicable to these circuits. An example of such a circuit is as follows. In the sixth embodiment, at least one of a plurality of heaters is connected to a battery at a different timing from the other heaters. Alternatively, in a circuit for preventing the excessive inrush current, a plurality of heaters are sequentially disconnected from a battery at different required timings after power is supplied. Also, in the sixth embodiment, a time-constant circuit is used to detect an elapsed time, therby obtaining a timing required for disconnecting a heater from a battery. However, a change in temperature of a high pressure discharge lamp or in temperature around a heater can be detected, or a change in the current flowing through a heater can be detected instead. In another circuit configuration, a plurality of heaters can be sequentially connected/disconnected with respect to a battery at different timings. In this case, a currently powered heater can be disconnected from the battery and then the next heater can be connected to the battery.

Figure 12:
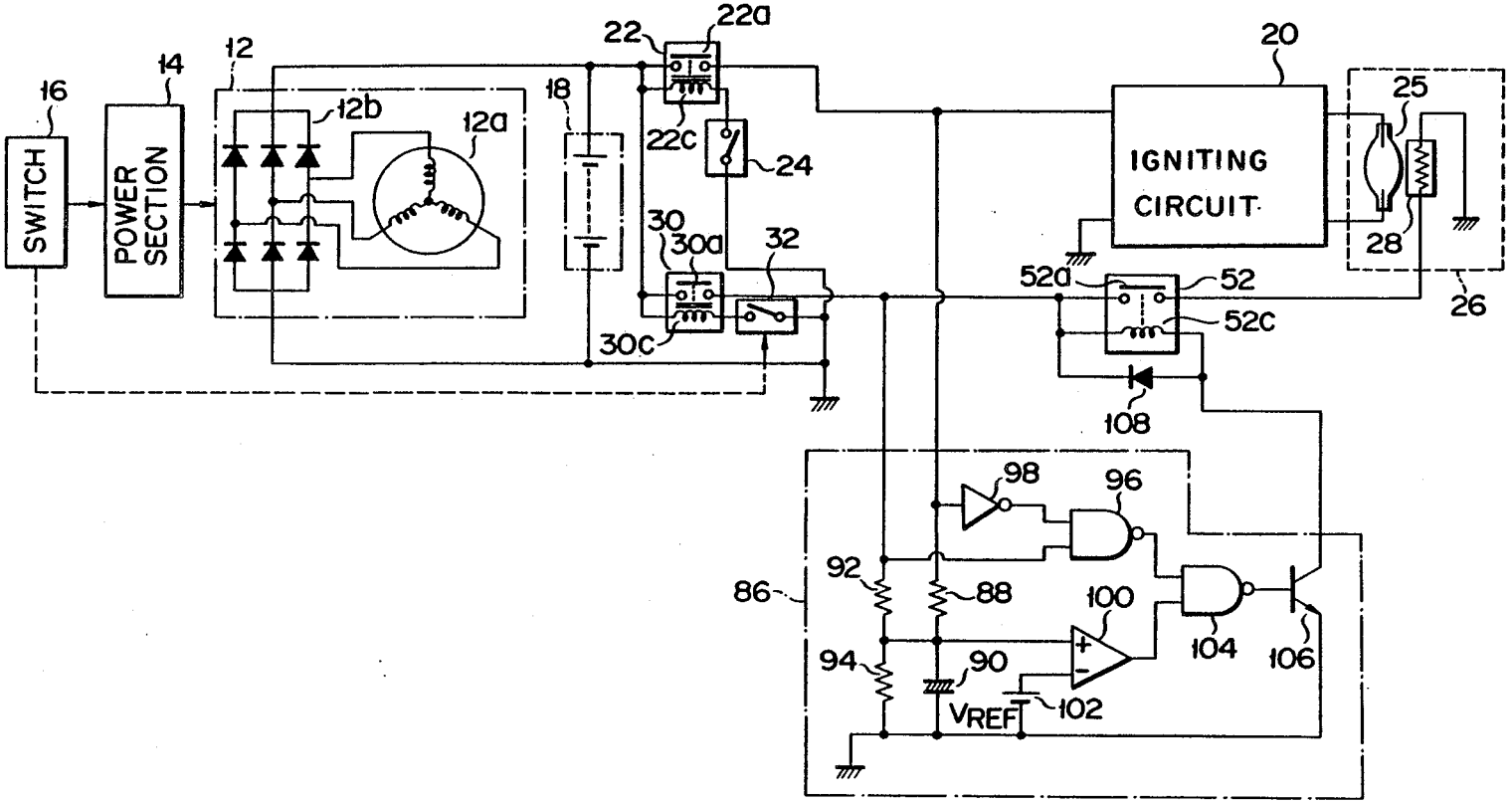
FIG. 12 is a circuit diagram of a seventh embodiment of the present invention.

FIG. 12 shows a seventh embodiment of the present invention. In the seventh embodiment, the present invention is applied to a starting and operating apparatus as follows. Namely, in this starting and operating apparatus, power supply to a heater after a discharge lamp is turned on is controlled in accordance with a heated state of a high pressure discharge lamp by a heater before it is started. As a result, once the rate of increase in luminous flux of the discharge lamp reaches a stable level, the discharge lamp is no longer heated by the heater. Thus, the luminous flux does not overshoot to degrade the service life of the discharge lamp.

More specifically, referring to FIG. 12, reference numeral 86 denotes a control circuit. Battery 18 is connected to a series circuit of resistor 88 and capacitor 90 of control circuit 86 through normally-open contact 22*a* of first relay 22, and to a series circuit of resistors 92 and 94 through normally-open contact 30*a* of second relay 30. Control circuit 86 has first NAND gate 96 having two input ends. One input of NAND gate 96 is connected to the node of first relay 22 and resistor 88 through inverter 98. The other input thereof is connected to the node of second relay 30 and resistor 92. Control circuit 86 also has comparator 100. The non-inverting input end (+) of comparator 100 as one input end is connected to the node of resistor 88 and capacitor 90 and to the node of resistors 92 and 94. The inverting input end (−) of comparator 100 as the other input end is connected to voltage source 102 for generating reference voltage $V_{REF}$.

Control circuit 86 also includes second NAND gate 104 having two input ends and npn transistor 106. The input ends of second NAND gate 104 are connected to the output end of first NAND gate 96 and the output end of comparator 100, respectively. The output end of NAND gate 104 is connected to the base of transistor 106. Battery 18 is connected in series with coil 52*c* of third relay 52 through normally-open contact 30*a* of second relay 30 and transistor 106. Coil 52*c* is connected in parallel with surge absorbing diode 108.

An operation of the seventh embodiment having the above arrangement will be described with reference to FIGS. 13A to 13H. FIGS. 13A to 13H respectively show the operation timings of the respective components in cases of: sufficient heating before starting (I) and insufficient heating before starting (II).

Case (I) will first be described. Assume that while first relay 22 is deenergized, as shown in FIG. 13A, second relay 30, i.e., switch 16 is turned on, as shown in FIG. 13C, to turn on control switch 32. Then as shown in FIG. 13B, since an output from inverter 98 is at high level, both inputs to first NAND gate 96 are at high level, and an output therefrom is at low level, as shown in FIG. 13D. Since a voltage is produced across resistor 94, capacitor 90 is charged with a predetermined time constant, as shown in FIG. 13E. However, since the voltage of capacitor 90 is lower than reference voltage $V_{REF}$, an output from comparator 100 goes low, as shown in FIG. 13F. Then, both inputs to second NAND gate 104 are set at high level, and an output therefrom is thus set at high level, as shown in FIG. 13G. This turns on transistor 106 to turn on third relay 52, as shown in FIG. 13H, and its normally-open contact 52*a* is closed. In this manner, power supply to heater 28 is started, and high pressure discharge lamp 26 is heated beforehand, i.e., preheated. In this case, battery 18 is charged as a matter of course.

Even if preheating continues for a comparatively long period of time, the charging speed of capacitor 90 is slow since it is charged only through resistor 92, and the charge voltage is thus not abruptly increased. Then, after a lapse of some time, operation switch 24 is turned on to energize first relay 22, as shown in FIG. 13A. Then, igniting circuit 20 is operated to start igniting light-emitting tube 25. At this time, the temperature of discharge lamp 26 is high since it has been heated for a comparatively long period of time. Discharge lamp 26 is thus started and reaches a stable ON level quickly.

When first relay 22 is energized, an output from inverter 98 is set at low level, as shown in FIG. 13B, and an output from first NAND gate 96 is set at high level, as shown in FIG. 13D. At this time, since an input to second NAND gate 104 supplied from comparator 100 is at low level, an output from gate 104 is kept at high level. When first relay 22 is energized, capacitor 90 is charged also through resistor 88, and its charging speed becomes fast, as shown in FIG. 13E. Capacitor 90 is precharged to a predetermined level within the preheat period. Therefore, when first relay 22 is energized, the voltage charged in capacitor 90 reaches reference voltage $V_{REF}$ within a comparatively short period of time. When the charged voltage reaches reference voltage $V_{REF}$, an output from comparator 100 is inverted and set at high level, as shown in FIG. 13F. Since both inputs to second NAND gate 104 are set at high level, an output from gate 104 is set at low level. Transistor 106 is thus turned off, third relay 52 is deenergized, as shown in FIG. 13H, and power supply to heater 28 is stopped. This state is maintained as long as first relay 22 is energized.

In this manner, when discharge lamp 26 is sufficiently heated before starting and then started, power supply to heater 28 is stopped within a short period of time, thus preventing luminous flux from overshooting Thereafter, if operation switch 24, i.e., first relay 22 is deenergized, an output from first NAND gate 96 is set at low level. Therefore, even if an output from comparator 100 is maintained at high level, an output from second NAND gate 104 is set at high level, and power supply to heater 78 is started again. Power supply to heater 28 is then stopped by turning off control switch 22, i.e., switch 16.

A case of (II) will be described. Assume that while first relay 22 is deenergized, as shown in FIG. 13A, second relay 30 is energized. In this case, since an output from inverter 98 is at high level, as shown in FIG. 13B, both inputs to first NAND gate 96 are set at high level, and an output therefrom is set at low level, as shown in FIG. 13D. Since a voltage is generated across resistor 94, capacitor 90 is charged with a predetermined time constant, as shown in FIG. 13E. However, since the voltage of capacitor 90 is lower than reference voltage $V_{REF}$, an output from comparator 100 is set at low level, as shown in FIG. 13F. Then, both inputs to second NAND gate 104 are set at low level, and an output therefrom is thus set at high level, as shown in FIG. 13G. This turns on transistor 106 to energize third relay 52, as shown in FIG. 13H, and normally-open contact 52a of relay 52 is closed. Power supply to heater 28 is started in this manner, and high-pressure discharge lamp 26 is preheated.

When first relay 22 is energized, as shown in FIG. 13A, while preheating is insufficient, igniting circuit 20 is operated to start light-emitting tube 25.

When first relay 22 is energized, capacitor 90 is charged also through resistor 88. Therefore, the charging speed of capacitor 90 becomes fast, as shown in FIG. 13E. Since capacitor 90 is not much charged during the preheat period, its charged level is low. Even when first relay 22 is energized and charging speed to capacitor 90 becomes fast, it takes some time before the charged voltage reaches reference voltage $V_{REF}$. Thus, even when discharge lamp 26 is started, power supply to heater 28 continues for some time. As a result, even if the temperature of discharge lamp 26 is not much high upon starting, it is heated by heater 28 as the starting continues, and is started to reach a stable ON state quickly.

Then, discharge lamp 26 reaches the stable ON state. In other words, the rate of increase in its luminous flux becomes stable. At this time, the charged voltage of capacitor 90 reaches voltage $V_{REF}$, transistor 100 is turned on and third relay 52 is energized, thus stopping power supply to heater 28.

When discharge lamp 26 is not sufficiently heated by heater 28 before starting and then started, power supply to heater 28 is continued for a comparatively long period of time. Thus, discharge lamp 26 is heated as starting continues, and is started to reach its stable ON stable quickly.

In this manner, power supply to a heater 28 after starting a discharge lamp 26 is controlled in accordance with the heated state of the discharge lamp 26 which is heated by a heater 28. Then, the fast rate of increase in luminous flux can constantly be obtained, and overshooting of luminous flux can be eliminated. In the seventh embodiment, the battery 18 is charged while the heater 28 is powered, in the same manner as in the embodiments described before. Therefore, the voltage of the battery 18 will not be decreased.

In the embodiment, the power supply time of the heater 28 after starting is initiated is changed for the cases of sufficient and insufficient preheating, thus changing the power supply. However, the present invention can also be applied to an apparatus wherein a current or voltage is changed, while its supply time is the same, to change power supply per unit time, thus changing power supply.

As described above, in a starting and operating apparatus of a high-pressure discharge lamp of the present invention which starts a high-pressure discharge lamp by using a battery as a power source, the rate of increase in luminous flux of the discharge lamp can be improved by using a heater, and the voltage of the battery will not be decreased.

What is claimed is:

1. An operating apparatus for a high-pressure discharge lamp having a light-emitting tube and a heater, said operating apparatus receiving power from a power source having a battery, charging means for charging the battery, and charging switch means for causing said charging means to start and stop the charging of said battery, said operating apparatus comprising:

operating circuit means, including light switch means independent of heater operation and lighting circuit means, for receiving the power supplied from said power source and for generating a predetermined output only when said light switch means is turned on so as to start and maintain an ON state of said light-emitting tube;

heater switch means, operated independently of said light switch means, for causing said heater to operate independently of an operating state of said light switch means; and heater control means for enabling power to be supplied to said heater by turning on said heater switch means only when said charging means is operated, and for turning off said heater switch means whenever said charging switch means is turned off.

2. An apparatus according to claim 1, wherein said heater control means starts power supply to said heater from said power source simultaneously when said charging switch means is turned on.

3. An apparatus according to claim 2, wherein said heater control means comprises first control switching means which is provided between said power source and said heater and is turned on synchronously with said charging switch means.

4. An apparatus according to claim 3, wherein said heater control means further includes stopping means for stopping power supply to said heater after said light-emitting tube becomes in a stable ON state.

5. An apparatus according to claim 4, wherein said stopping means includes power supply stop means for stopping power supply to said heater when a predetermined period of time has elapsed after said light switch means is turned on.

6. An apparatus according to claim 2, wherein said charging means includes a generator and a power section for driving said generator when said heater switch means is turned on, and said heater control means starts power supply to said heater from said power source simultaneously when operation of said power section is started.

7. An apparatus according to claim 2, wherein said charging means includes a transformer to be connected to an AC power source when said heater switch means is turned on, and said heater control means starts power supply to said heater from said power source simultaneously when said transformer is connected to said AC power source.

8. An apparatus according to claim 1, wherein said heater control means starts power supply from said power source to said heater in synchronism with starting of said light switch means when said heater switch means is turned on.

9. An apparatus according to claim 8, further comprising operation switch means, provided between said power source and said operating circuit means, for operating said operating circuit means, wherein said heater control means comprises first control switching means, which is turned on synchronously with said charging switch means, for connecting said power source and said heater through said light switch means in an ON state thereof.

10. An apparatus according to claim 9, wherein said heater control means further includes stopping means for stopping power supply to said heater after said light-emitting tube becomes in a stable ON state.

11. An apparatus according to claim 10, wherein said stopping means includes power supply stop means for stopping power supply to said heater when a predetermined period of time has elapsed after said light switch means is turned on.

12. An apparatus according to claim 8, wherein said charging means includes a generator and a power section for driving said generator when said heater switch means is turned on, and said heater control means starts power supply to said heater from said power source when operation of said power section is started and said light-emitting tube is started.

13. An apparatus according to claim 8, wherein said charging means includes a transformer to be connected to an AC power source when said heater switch means is turned on, and said heater control means starts power supply to said heater from said power source when said transformer is connected to said AC power source and said light-emitting tube is started.

14. An apparatus according to claim 8, wherein said heater control means further includes means for starting power supply from said power source to said heater simultaneously with starting of said light-emitting tube.

15. An apparatus according to claim 1, wherein said heater is provided near said light-emitting tube provided in said high pressure discharge lamp.

16. An operating apparatus for an automobile head light having a light-emitting tube and a heater, said operating apparatus receiving power from a power source having a battery, charging means for charging the battery, and charging switch means for causing said charging means to start and stop the charging of said battery, said operating apparatus comprising:

operating circuit means, including light switch means independent of heater operation and lighting circuit means, for receiving the power supplied from said power source and for generating a predetermined output only when said light switch means is turned on so as to start and maintain an ON state of said light-emitting tube;

heater switch means, operated independently of said light switch means, for causing said heater to operate independently of an operating state of said light switch means; and heater control means for enabling power to be supplied to said heater by turning on said heater switch means only when said charging means is operated, and for turning off said heater switch means whenever said charging switch means is turned off.

17. An apparatus according to claim 16, wherein said heater is provided near said light-emitting tube provided in said automobile head light.

18. An apparatus according to claim 16, wherein said heater control means starts power supply to said heater from said power source simultaneously when operation of said charging means is started.

19. An apparatus according to claim 16, wherein said heater control means starts power supply from said power source to said heater in synchronism with starting of said light switch means when said heater switch means is turned on.

20. An operating apparatus for high-pressure discharge lamps, each lamp having a light-emitting tube and a heater, said operating apparatus receiving power from a power source having a battery, charging means for charging the battery, and charging switch means for causing said charging means to start and stop the charging of said battery said operating apparatus comprising:

operating circuit means, including light switch means independent of heater operation and lighting circuit means, for receiving the power supplied from said power source and for generating a predetermined output only when said light switch means is turned on so as to start and maintain an ON state of said light-emitting tubes, said operating circuit means further including means for outputting, in turn, said predetermined outputs to each of said light-emitting tubes;

heater switch means, operated independently of said light switch means, for causing said heaters to operate independently of an operating state of said light switch means; and heater control means for sequentially enabling power to be supplied to each of said heaters from said power source by turning on said heater switch means only when said charging means is operated, and for turning off said heater switch means whenever said charging switch means is turned off.

* * * * *